US010304674B2

(12) United States Patent
Kenny et al.

(10) Patent No.: US 10,304,674 B2
(45) Date of Patent: May 28, 2019

(54) TIME OF FLIGHT MASS SPECTROMETER

(71) Applicant: Micromass UK Limited, Wilmslow (GB)

(72) Inventors: Daniel James Kenny, Knutsford (GB); Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/504,434

(22) PCT Filed: Aug. 19, 2015

(86) PCT No.: PCT/GB2015/052405

§ 371 (c)(1),
(2) Date: Feb. 16, 2017

(87) PCT Pub. No.: WO2016/027085

PCT Pub. Date: Feb. 25, 2016

(65) Prior Publication Data

US 2017/0236700 A1 Aug. 17, 2017

(30) Foreign Application Priority Data

Aug. 19, 2014 (EP) ..... 14181394
Aug. 19, 2014 (GB) ..... 1414688.0

(51) Int. Cl.
*H01J 49/00* (2006.01)
*H01J 49/40* (2006.01)

(52) U.S. Cl.
CPC ..... *H01J 49/40* (2013.01); *H01J 49/0031* (2013.01)

(58) Field of Classification Search
None
See application file for complete search history.

(56) References Cited

U.S. PATENT DOCUMENTS 5,396,065 A 3/1995 Myerholtz et al.
6,861,645 B2 3/2005 Franzen
7,759,655 B2 * 7/2010 McCauley ..... H01J 49/429 250/281
8,410,430 B2 4/2013 Kenny et al.
(Continued)

FOREIGN PATENT DOCUMENTS

GB 2486820 6/2012

*Primary Examiner* — Andrew Smyth

(57) ABSTRACT

There is provided a mass spectrometer comprising a time of flight mass analyzer comprising an acceleration electrode, a time of flight region and an ion detector, and a control system arranged and adapted (i) to apply a plurality of extraction pulses to said acceleration electrode in order to accelerate consecutive groups of ions into said time of flight region, wherein ions having a relatively high mass to charge ratio in a preceding group of ions arrive at said detector after ions having a relatively low mass to charge ratio in a subsequent group of ions, wherein ions within each consecutive group of ions have a mass to charge ratio within one or more predetermined, selected or otherwise known mass to charge ratio ranges, and (ii) to determine a frequency or period of said plurality of extraction pulses that will avoid coincidence of ions from said consecutive groups of ions at said ion detector, wherein said plurality of extraction pulses are applied at said determined frequency or period.

19 Claims, 5 Drawing Sheets

(56) References Cited

U.S. PATENT DOCUMENTS

| | | | | |
|---|---|---|---|---|
| 8,803,083 | B2 | 8/2014 | Goldberg | |
| 9,048,081 | B2 | 6/2015 | Green et al. | |
| 9,406,493 | B2 | 8/2016 | Verenchikov | |
| 2005/0133712 | A1 | 6/2005 | Belov et al. | |
| 2010/0096543 | A1* | 4/2010 | Kenny | H01J 49/401 250/282 |
| 2011/0204221 | A1* | 8/2011 | Satake | H01J 49/0031 250/282 |
| 2013/0334413 | A1* | 12/2013 | Green | H01J 49/0031 250/282 |

* cited by examiner

TIME OF FLIGHT MASS SPECTROMETER

CROSS-REFERENCE TO RELATED APPLICATIONS

This application represents the U.S. National Phase of International Application number PCT/GB2015/052405 entitled "Time of Flight Mass Spectrometer" filed 19 Aug. 2015, which claims priority from and the benefit of United Kingdom patent application No. 1414688.0 filed on 19 Aug. 2014 and European patent application No. 14181394.9 filed on 19 Aug. 2014. The entire contents of these applications are incorporated herein by reference.

FIELD OF THE INVENTION

The present invention relates generally to mass spectrometry and in particular to mass spectrometers and methods of mass spectrometry. Various embodiments relate to a time of flight mass spectrometer.

BACKGROUND

Historically time of flight mass spectrometers have been employed due to their high mass accuracy, resolution and duty cycle. In addition to these benefits time of flight mass spectrometers also benefits from a large mass or mass to charge ratio range. The large mass range is useful for many applications.

However, there are some applications that are focused on measuring targeted subsets of the mass range, such as selected ion monitoring or recording ("SIR") and multiple reaction monitoring ("MRM"). In these experiments the high resolution and mass accuracy of time of flight mass spectrometers is still of significant benefit in improving the specificity and/or selectivity of the measurement whereas the wide mass range is of limited use.

GB2486820 ("Micromass") discloses a method of exploiting a restricted mass range entering the time of flight mass spectrometer to improve the duty cycle of the experiment, in order to improve the dynamic range and/or the sensitivity of the experiment.

US2014/0138526 ("Goldberg") discloses a time of flight mass spectrometer.

WO2008/087389 ("Micromass") discloses a mass spectrometer.

GB2505265 ("Micromass") discloses multi-dimensional survey scans for improved data dependent acquisitions (DDA).

GB2396957 ("Franzen") discloses a high resolution orthogonal acceleration TOF mass spectrometer with a high duty cycle.

U.S. Pat. No. 5,399,065 ("Myerholtz") discloses sequencing ion packets for ion Time-of-Flight mass spectrometry.

WO2011/135477 ("Verenchikov") discloses electrostatic mass spectrometer with encoded frequent pulses.

US2005/133712 ("Belov") discloses scan pipelining for sensitivity improvement of orthogonal Time-of-Flight mass spectrometers, Time of flight mass analysers typically use a pusher or acceleration electrode to accelerate groups of ions into a time of flight region.

It is desired to provide an improved mass spectrometer.

SUMMARY

According to an aspect of the present disclosure there is provided a mass spectrometer comprising:

a time of flight mass analyser comprising an acceleration electrode, a time of flight region and an ion detector; and a control system arranged and adapted:

(i) to apply a plurality of extraction pulses to the acceleration electrode in order to accelerate consecutive groups of ions into the time of flight region, wherein ions having a relatively high mass to charge ratio in a preceding group of ions arrive at the detector after ions having a relatively low mass to charge ratio in a subsequent group of ions, wherein ions within each consecutive group of ions have a mass to charge ratio within one or more predetermined, selected or otherwise known mass to charge ratio ranges; and (ii) to determine or predetermine a frequency or period of the plurality of extraction pulses that will avoid coincidence of ions from the consecutive groups of ions at the ion detector;

wherein the plurality of extraction pulses are applied at the determined frequency or period.

It has been realised that an increase in duty cycle can be achieved in time of flight mass spectrometry by modifying the timing, frequency or period of extraction pulses applied to an acceleration electrode.

Specifically, the ions within each consecutive group of ions have a mass to charge ratio within one or more predetermined, selected or otherwise known mass to charge ratio ranges, which information can then be used to determine a frequency or period of the plurality of extraction pulses that will avoid coincidence of ions from the consecutive groups of ions at the ion detector.

This is distinct from, for example, the approach taken in US2014/0138526 ("Goldberg"), in which ions that are passed to the pusher electrode do not have a mass to charge ratio within one or more predetermined, selected or otherwise known mass to charge ratio ranges. The method of Goldberg chooses a pulsing interval based on trial and error during multiple acquisitions of a reference sample, and not using predetermined, selected or otherwise known mass to charge ratio information as disclosed herein.

The methods disclosed herein are also distinct from methods that use post-processing techniques to identify and correct coincidence of ions from different groups of ions, see for example WO-2008/087389 ("Micromass"), as well as methods that attempt to prevent intermixing of the groups of ions by delaying the extraction pulse, see for example GB-2486820 ("Micromass").

In these conventional arrangements there is no determination in advance of a frequency or period of the plurality of extraction pulses that will avoid coincidence of ions from different groups of ions at the ion detector, whilst intermixing different groups of ions. The duty cycle is improved for multiple target masses and/or mass windows in selected ion monitoring or recording, or similar experiments.

The terms "coincide" or "coincidence" as used herein may mean that ions exhibit the same or a similar arrival time, for example ions from one group of ions may exhibit an arrival time within +/−0%, 2%, 5%, 10%, 15%, 20%, 25%, 30%, 35%, 40%, 45%, 50%, 55%, 60%, 65%, 70%, 75%, 80%, 85%, 90%, 95%, or 100% of the arrival time of ions from another group of ions.

As stated above, ions having a relatively high mass to charge ratio in a preceding group of ions arrive at the detector after ions having a relatively low mass to charge ratio in a subsequent group of ions. In other words, the groups of ions are intermixed. This is distinct from arrangements in which the pusher frequency is reduced, but the groups of ions are not intermixed.

The frequency or period may be determined by calculating the times of flight of ions in the consecutive groups of ions, and determining a frequency or period of the plurality of extraction pulses that prevents or will prevent ions from one group of ions arriving at the detector at substantially the same time as ions from another group of ions.

The times of flight of ions in the consecutive groups of ions may be calculated based on the mass to charge ratio of ions in the consecutive groups of ions. The times of flight of ions in the consecutive groups of ions may be calculated based on the predetermined, selected or otherwise known mass to charge ratio ranges.

The mass to charge ratio or mass to charge ratio range(s) of ions in the consecutive groups of ions may be predetermined, given, assumed, or otherwise known. For example, the ions entering the Time-of-Flight region may be or may have been pre-filtered according to mass to charge ratio. The mass to charge ratio range(s) could be known from a pre-processing technique such as a pre-scan.

Any separation by mass, mass to charge ratio, ion mobility or differential ion mobility may be lost upon entry of the ions into the time of flight mass analyser or time of flight region. For example, having been selected, filtered or separated according to mass, mass to charge ratio, ion mobility or differential ion mobility, the ions could be passed to an ion trap such that any separation according to mass, mass to charge ratio, ion mobility or differential ion mobility is lost, prior to the ions then being passed to the time of flight mass analyser or time of flight region.

The mass spectrometer may further comprise a restriction device arranged and adapted to restrict the mass to charge ratio range(s) of ions in each consecutive group of ions. The mass to charge ratio or mass to charge ratio range(s) of ions in each consecutive group of ions may be known based on the restricted mass to charge ratio range(s) passed by the restriction device. The restriction device is optionally arranged upstream of the time of flight mass analyser. The restriction device may comprise a quadrupole mass filter.

The mass spectrometer may further comprise a separator or filter that may be arranged upstream or downstream from the restriction device. The separator or filter may be arranged and adapted to sequentially select and transmit a plurality of ions of interest based upon a first physico-chemical property.

The mass spectrometer may comprise a second separator or filter for separating or filtering ions according to a second physico-chemical property.

The control system may be arranged and adapted:

(i) to perform an initial multi-dimensional survey scan comprising separating parent ions according to the first physico-chemical property using the first separator and separating the parent ions according to the second physico-chemical property using the second separator;

(ii) to determine a plurality of parent ions of interest from the initial multi-dimensional survey scan; and then (iii) to sequentially select and transmit the plurality of parent ions of interest based upon the first physico-chemical property and/or the second physico-chemical property during a single acquisition or cycle of separation; and (iv) to cause the analyser to analyse either: (i) the one or more parent ions of interest; and/or (ii) one or more fragment, product or other ions derived from the one or more parent ions of interest.

The restriction device and/or first or second separator and/or first or second filter may be selected from the group consisting of: (i) a further mass spectrometer or mass analyser; (ii) an ion trap; (iii) a Time of Flight mass analyser; (iv) an ion trap having one or more pseudo-potential barriers wherein ions are scanned out of the ion trap via the one or more pseudo-potential barriers; (v) a mass filter; (vi) a quadrupole mass filter; (vii) a magnetic sector mass filter; and (viii) an ion mobility spectrometer or separator.

The first physico-chemical property and/or second physico-chemical property may comprise mass, mass to charge ratio, ion mobility or differential ion mobility.

The plurality of extraction pulses may comprise a first extraction pulse applied to the acceleration electrode in order to accelerate a first group of ions into the time of flight region at a first time T1, wherein ions having the lowest mass to charge ratio in the first group of ions may have a time of flight $\Delta T1_{min}$ through the time of flight region and ions having the highest mass to charge ratio in the first group of ions may have a time of flight $\Delta T1_{max}$ through the time of flight region. The plurality of extraction pulses may comprise a second extraction pulse applied to the acceleration electrode at a subsequent second time in order to accelerate a second group of ions into the time of flight region at a second time T2, wherein optionally $T2-T1<\Delta T1_{max}-\Delta T1_{min}$.

Ions having the lowest mass to charge ratio in the second group of ions may have a time of flight $\Delta T2_{min}$ through the time of flight region and ions having the highest mass to charge ratio in the second group of ions may have a time of flight $\Delta T2_{max}$ through the time of flight region, wherein optionally $T2-T1\geq\Delta T2_{min}-\Delta T1_{min}$.

The control system may be arranged and adapted to apply a third and/or further extraction pulse(s) to the acceleration electrode in order to accelerate a third and/or further group(s) of ions into the time of flight region.

The first, second, third and/or further extraction pulses may be applied and/or timed such that ions from the first, second, third and/or further groups of ions do not coincide with one another at the detector.

The control system may be arranged and adapted to identify and/or determine a range of frequencies or periods of the extraction pulses that will avoid coincidence of ions from different groups of ions at the ion detector.

The plurality of extraction pulses may be applied at the highest frequency or lowest period identified and/or determined.

The control system may be arranged and adapted to increase the frequency or decrease the period of the extraction pulses to a frequency or period within the range of frequencies or periods of the extraction pulses that will avoid coincidence of ions from different groups of ions at the ion detector.

The control system may be arranged and adapted to increase the frequency or decrease the period of the extraction pulses to or near to a maximum frequency or minimum period within the range of frequencies or periods of the extraction pulses that will avoid coincidence of ions from different groups of ions at the ion detector.

According to an aspect of the disclosure there is provided a method of mass spectrometry, comprising:

providing a time of flight mass analyser comprising an acceleration electrode, a time of flight region and an ion detector;

applying a plurality of extraction pulses to the acceleration electrode in order to accelerate consecutive groups of ions into the time of flight region, wherein ions having a relatively high mass to charge ratio in a preceding group of ions arrive at the detector after ions having a relatively low mass to charge ratio in a subsequent group of ions, wherein ions within each consecutive group of ions have a mass to charge ratio within one or more predetermined, selected or otherwise known mass to charge ratio ranges;

determining a frequency or period of the plurality of extraction pulses that will avoid coincidence of ions from the consecutive groups of ions at the ion detector; and wherein the plurality of extraction pulses are applied at the determined frequency or period.

According to an aspect of the disclosure there is provided a method of mass spectrometry comprising:

providing a population of ions of different mass to charge ratio, wherein the mass to charge ratio of at least one or more component(s) is either known or assumed;

analysing the population of ions in a time of flight mass analyser, wherein the time of flight mass analyser operates in a manner where the pusher period is less than the range of times of flight, and ions from lower mass to charge ratio regions from later pushes can catch and overtake ions from higher mass to charge ratio regions from earlier pushes;

wherein the pusher period or frequency is chosen so that the arrival time regions associated with different mass to charge ratio regions are non-overlapping.

Fast pushing time of flight for multiple mass ranges in accordance with various embodiments is a novel method of operation for current and future instrument geometries.

Various embodiments disclosed herein provide the capability to increase the pusher frequency and/or duty cycle and/or dynamic range of a time of flight mass analyser. The embodiments may comprise at least a means of isolating and onwardly transmitting restricted mass to charge ratio ranges and optionally a time of flight mass spectrometer. Multiple target ions are optionally identified in isolated and filtered mass to charge ratio ranges, before the isolated and filtered ions are optionally onwardly transmitted to a time of flight mass analyser that is optionally operating at a pusher period arranged so that the multiple mass to charge ratio ranges arrive at the detector of the time of flight mass spectrometer at non-overlapping times.

According to an aspect of the present disclosure there is provided a mass spectrometer comprising:

a time of flight mass analyser comprising an acceleration electrode, a time of flight region and an ion detector; and a control system arranged and adapted:

(i) to apply a plurality of extraction pulses to the acceleration electrode in order to accelerate consecutive groups of ions into the time of flight region, wherein ions having a relatively high mass to charge ratio in a preceding group of ions arrive at the ion detector after ions having a relatively low mass to charge ratio in a subsequent group of ions; and (ii) to determine a frequency or period of the plurality of extraction pulses that will avoid coincidence of ions from different groups of ions at the ion detector;

wherein the plurality of extraction pulses are applied at the frequency or period.

The frequency or period may be determined by calculating the times of flight of ions in the consecutive groups of ions, and determining a frequency or period of the plurality of extraction pulses that prevents ions from one group of ions arriving at the detector at substantially the same time as ions from another group of ions.

The times of flight of ions in the consecutive groups of ions may be calculated based on the mass to charge ratio of ions in the consecutive groups of ions.

The mass to charge ratio or mass to charge ratio range(s) of ions in the consecutive groups of ions may be predetermined, given, assumed, or otherwise known, for example from a pre-processing technique such as a pre-scan.

The mass spectrometer may further comprise a restriction device arranged and adapted to restrict the mass to charge ratio range(s) of ions in each consecutive group of ions. The mass to charge ratio or mass to charge ratio range(s) of ions in each consecutive group of ions may be known based on the restricted mass to charge ratio range(s) passed by the restriction device.

The mass spectrometer may further comprise a separator or filter arranged upstream or downstream from the restriction device, wherein the separator or filter is arranged and adapted to sequentially select and transmit a plurality of ions of interest based upon a first physico-chemical property.

The mass spectrometer may comprise a second separator or filter for separating or filtering ions according to a second physico-chemical property.

The control system may be arranged and adapted:

(i) to perform an initial multi-dimensional survey scan comprising separating parent ions according to the first physico-chemical property using the first separator and separating the parent ions according to the second physico-chemical property using the second separator;

(ii) to determine a plurality of parent ions of interest from the initial multi-dimensional survey scan; and then (iii) to sequentially select and transmit the plurality of parent ions of interest based upon the first physico-chemical property and/or the second physico-chemical property during a single acquisition or cycle of separation; and (iv) to cause the analyser to analyse either: (i) the one or more parent ions of interest; and/or (ii) one or more fragment, product or other ions derived from the one or more parent ions of interest.

The restriction device and/or first or second separator and/or first or second filter may be selected from the group consisting of: (i) a further mass spectrometer or mass analyser; (ii) an ion trap; (iii) a Time of Flight mass analyser; (iv) an ion trap having one or more pseudo-potential barriers wherein ions are scanned out of the ion trap via the one or more pseudo-potential barriers; (v) a mass filter; (vi) a quadrupole mass filter; (vii) a magnetic sector mass filter; and (viii) an ion mobility spectrometer or separator.

The first physico-chemical property and/or second physico-chemical property may comprise mass or mass to charge ratio, ion mobility or differential ion mobility.

The plurality of extraction pulses may comprise a first extraction pulse applied to the acceleration electrode in order to accelerate a first group of ions into the time of flight region at a first time T1, wherein ions having the lowest mass to charge ratio in the first group of ions may have a time of flight $\Delta T1_{min}$ through the time of flight region and ions having the highest mass to charge ratio in the first group of ions may have a time of flight $\Delta T1_{max}$ through the time of flight region. The plurality of extraction pulses may comprise a second extraction pulse applied to the acceleration electrode at a subsequent second time in order to accelerate a second group of ions into the time of flight region at a second time T2, wherein optionally $T2-T1<\Delta T1_{max}-\Delta T1_{min}$.

Ions having the lowest mass to charge ratio in the second group of ions may have a time of flight $\Delta T2_{min}$ through the time of flight region and ions having the highest mass to charge ratio in the second group of ions may have a time of flight $\Delta T2_{max}$ through the time of flight region, wherein optionally $T2-T1\geq\Delta T2_{min}-\Delta T1_{min}$.

The control system may be arranged and adapted to apply a third and/or further extraction pulse(s) to the acceleration electrode in order to accelerate a third and/or further group(s) of ions into the time of flight region.

The first, second, third and/or further extraction pulses may be applied and/or timed such that ions from the first, second, third and/or further groups of ions do not coincide with one another at the detector.

The control system may be arranged and adapted to identify and/or determine a range of frequencies or periods of the extraction pulses that will avoid coincidence of ions from different groups of ions at the ion detector.

The plurality of extraction pulses may be applied at the highest frequency or lowest period identified and/or determined.

The control system may be arranged and adapted to increase the frequency or decrease the period of the extraction pulses to a frequency or period within the range of frequencies or periods of the extraction pulses that will avoid coincidence of ions from different groups of ions at the ion detector.

The control system may be arranged and adapted to increase the frequency or decrease the period of the extraction pulses to or near to a maximum frequency or minimum period within the range of frequencies or periods of the extraction pulses that will avoid coincidence of ions from different groups of ions at the ion detector.

According to an aspect of the disclosure there is provided a method of mass spectrometry, comprising:

providing a time of flight mass analyser comprising an acceleration electrode, a time of flight region and an ion detector;

applying a plurality of extraction pulses to the acceleration electrode in order to accelerate consecutive groups of ions into the time of flight region, wherein ions having a relatively high mass to charge ratio in a preceding group of ions arrive at the detector after ions having a relatively low mass to charge ratio in a subsequent group of ions; and determining a frequency or period of the plurality of extraction pulses that will avoid coincidence of ions from different groups of ions at the ion detector;

wherein the plurality of extraction pulses are applied at the frequency or period.

According to an aspect of the disclosure there is provided a method of mass spectrometry comprising:

providing a population of ions of different mass to charge ratio, wherein the mass to charge ratio of at least one or more component(s) is either known or assumed;

analysing the population of ions in a time of flight mass analyser, wherein the time of flight mass analyser operates in a manner where the pusher period is less than the range of times of flight, and ions from lower mass to charge ratio regions from later pushes can catch and overtake ions from higher mass to charge ratio regions from earlier pushes;

wherein the pusher period or frequency is chosen so that the arrival time regions associated with different mass to charge ratio regions are non-overlapping.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix)>about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

A chromatography detector may be provided wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The mass spectrometer may be operated in various modes of operation including a mass spectrometry ("MS") mode of operation, a tandem mass spectrometry ("MS/MS") mode of operation, a mode of operation in which parent or precursor ions are alternatively fragmented or reacted so as to produce fragment or product ions, and not fragmented or reacted or fragmented or reacted to a lesser degree, a Multiple Reaction Monitoring ("MRM") mode of operation, a Data Dependent Analysis ("DDA") mode of operation, a Data Independent Analysis ("DIA") mode of operation, a Quantification mode of operation or an Ion Mobility Spectrometry ("IMS") mode of operation.

BRIEF DESCRIPTION OF THE DRAWINGS

Various embodiments of the present disclosure will now be described, by way of example only, and with reference to the accompanying drawings in which:

FIG. 4(*b*) shows a graph in the form of a timing diagram that illustrates how the time of flight pusher frequency can be modified (increased) to avoid coincidence

DETAILED DESCRIPTION

An embodiment of the present disclosure will now be described.

Figure 1:
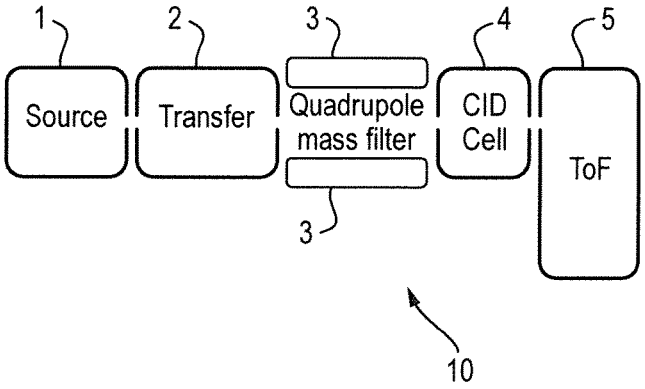
FIG. 1 shows a mass spectrometer according to an embodiment, in which ions are optionally pre-filtered according to their mass to charge ratio values before being onwardly transmitted to a time of flight mass analyser.

With reference to FIG. 1, in a mass spectrometer 10 ions are optionally pre-filtered according to their mass to charge ratio values so that multiple restricted mass to charge ratio ranges may be onwardly transmitted to the time of flight mass analyser 5. The time of flight mass analyser 5 optionally comprises an acceleration electrode or "pusher", a time of flight region and an ion detector (not shown). The mass spectrometer 10 further comprises an ion source 1 and a transfer device 2.

The mass to charge ratio filter may be a resolving quadrupole 3 in optionally a quadrupole time of flight ("Q-ToF") type geometry. For descriptive purposes only the quadrupole 3 in FIG. 1 may be arranged to alternate between transmitting two mass to charge ratio regions, $m_1+/-\Delta m_1$ and $m_2+/-\Delta m_2$.

Ions from the two mass to charge ratio regions transmitted may enter a collisional cooling gas cell 4 where they may or may not be allowed to mix together optionally before being onwardly transmitted to the time of flight mass spectrometer 5.

Figure 2:
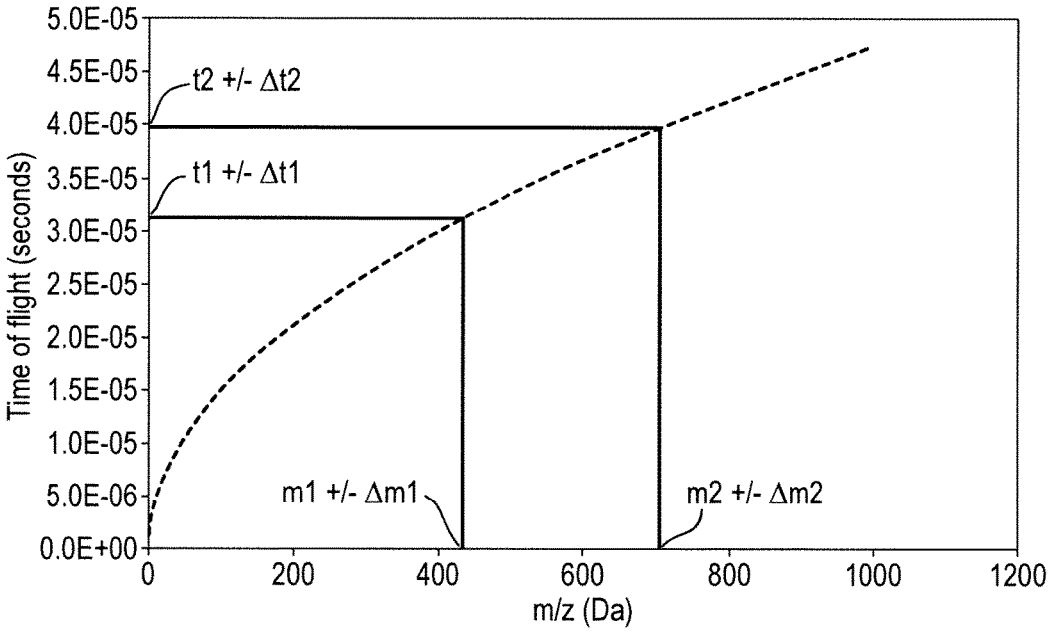
FIG. 2 shows a graph illustrating a relationship between time of flight and mass to charge ratio.

As the restricted mass to charge ratio ranges may be known in advance the time of flight ranges may be calculated from the mass to charge ratio ranges in a time of flight vs. mass to charge ratio relationship, as shown in FIG. 2.

The control system of the mass spectrometer 10 may be arranged and adapted to operate at a pusher frequency such that ions from the two mass to charge ratio ranges are optionally not coincident at the detector. This may allow direct measurement of mass to charge ratio whilst optionally maintaining the mass accuracy and resolution benefits of the time of flight mass spectrometer.

Using this approach the pusher frequency may be increased substantially over the traditional pusher frequency that may otherwise have been chosen to analyse the combined ion population.

The conventional pusher frequency may be greater than the time of flight corresponding to the maximum mass to charge ratio value within the two windows or, as in GB-2486820 ("Micromass"), greater than the range of time of flight values corresponding to the maximum mass to charge ratio value of the higher mass to charge ratio window and the minimum mass to charge ratio value of the lower mass to charge ratio window.

Figure 3:
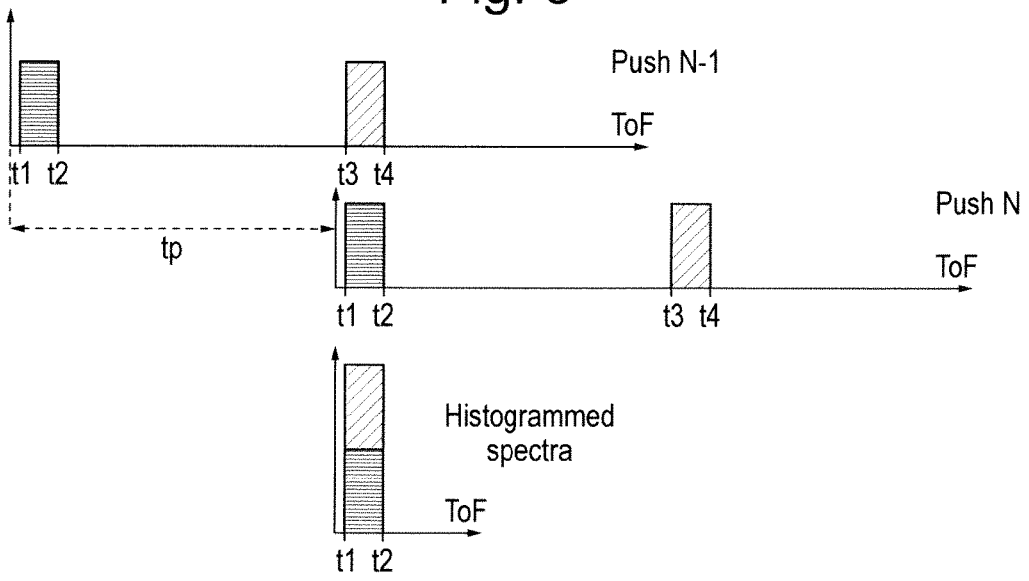
FIG. 3 shows a graph in the form of a timing diagram that illustrates how groups of ions from adjacent pushes can result in coincident groups of ions at a detector.

FIG. 3 shows a timing diagram as an aid to explain the increases in pusher frequency. Considering the simple example of two pre-isolated mass to charge ratio ranges, corresponding to two time of flight ranges of $t_1$-$t_2$ and $t_3$-$t_4$ respectively, it is clear from FIG. 3 that when considering two temporally adjacent pushes the two time of flight ranges may be coincident at the detector when $t_3=t_p+t_1$ or (rear-ranged) $t_p=t_3-t_1$, where $T_p$ is optionally the pusher period.

In these instances the final spectra, represented by a histogram, may undesirably contain multiple mass to charge ratio ranges at the same recorded times of flight.

Figure 4A:
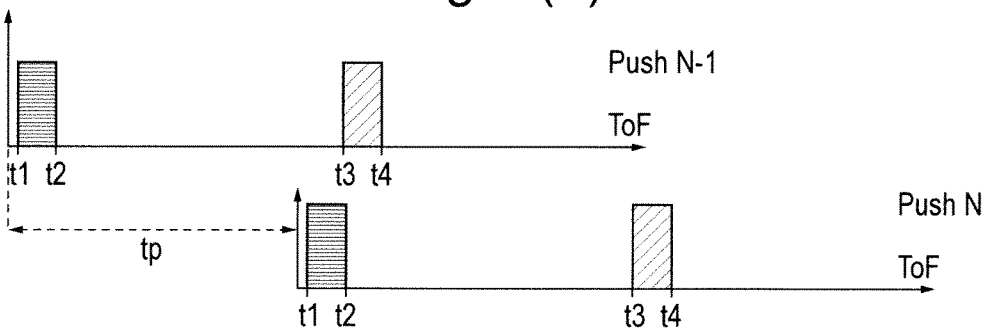
FIG. 4(*a*) shows a graph in the form of a timing diagram that illustrates how the time of flight pusher frequency can be modified (reduced) to avoid coincidence.
Figure 4B:
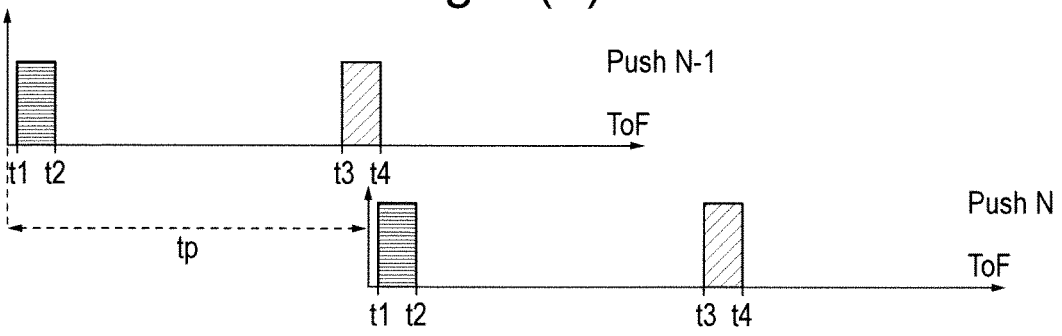

As shown in FIG. 4 the temporal width of the time of flight windows may lead to the requirement that $t_p<t_3-t_2$, and/or $t_p>t_4-t_1$, and/or $t_3-t_2>t_p>t_4-t_1$ to optionally avoid any overlap of the two time of flight ranges.

Figure 5:
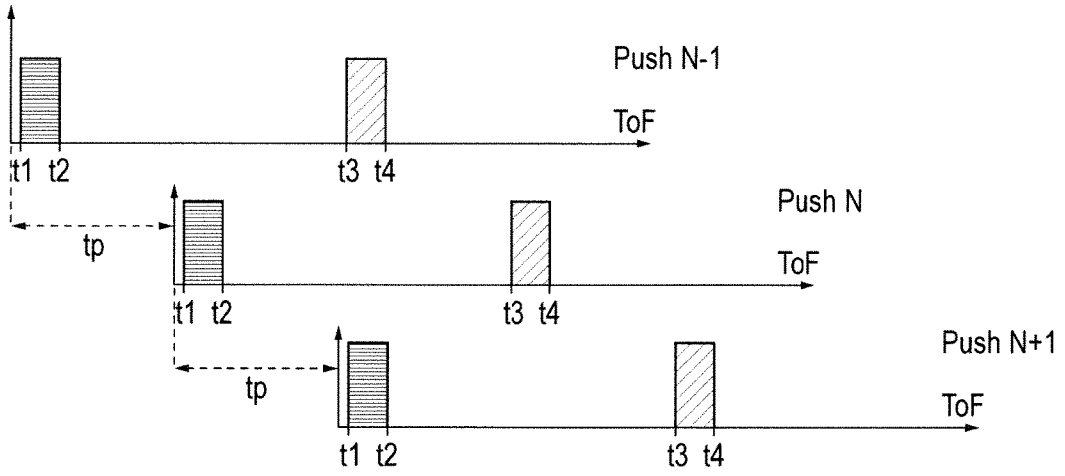
FIG. 5 shows a graph in the form of a timing diagram that illustrates how groups of ions from non-adjacent pushes can result in coincident groups of ions at a detector.

As shown in FIG. 5, it may be a requirement that ions from different time of flight regions from non-adjacent pushes do not arrive at the detector at the same time. In FIG. 5 the $t_1$-$t_2$ time of flight range from push N−1 may undesirably arrive at the detector at the same time as the $t_3$-$t_4$ time of flight range from push N+1. This may extend the requirement from FIG. 4 to this instance, which may place the additional requirement that $t_p<[t_3-t_2]/2$ and/or $t_p>[t_4-t_1]/2$ and/or $[t_3-t_2]/2>t_p>[t_4-t_1]/2$.

More generally when considering multiple pushes the pusher period may be required to satisfy $[t_3-t_2]/n>t_p>[t_4-t_1]/n$, where n is an integer from 1 to the number of pushes.

Using these basic equations it may be possible to identify a range of pusher periods that prevent overlapping time of flight regions optionally based on the mass to charge ratio range and/or the anticipated number of pushes. The reduced pusher period may lead to more pushes per second, optionally improving dynamic range and/or duty cycle and/or sensitivity.

Whilst the examples shown here are specifically concerned with two mass to charge ratio ranges the principle may be extendable to three or more mass to charge ranges, where the pusher period may be arranged so that the arrival time of each mass to charge ratio range is not coincident at the detector with the arrival time of any other mass to charge ratio range.

Other instrument geometries other than standard Q-ToF geometries may benefit from the described approach. For example, the quadrupole may be preceded or followed by an ion mobility spectrometer or separator 6 as shown in FIGS. 6 and 7.

Figure 6:
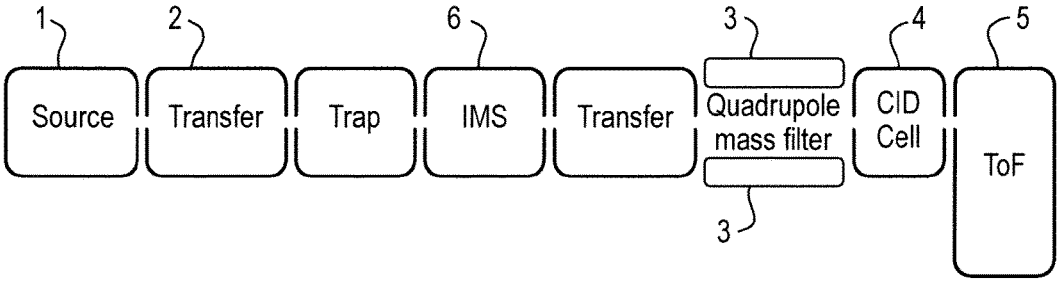
FIG. 6 shows a mass spectrometer according to an embodiment, in which an ion mobility spectrometer or separator precedes a quadrupole mass filter.

FIG. 6 shows a mass spectrometer comprising a quadrupole 3 that may be preceded by an ion mobility spectrometer or separator 6. In this configuration it may be possible to further enhance the duty cycle by optionally isolating multiple mass to charge ratio ranges sequentially within a cycle of the ion mobility spectrometer or separator. This may be in addition to increasing the precursor isolation duty cycle. This approach may also improve the selectivity and/or specificity of the isolation step.

Figure 7:
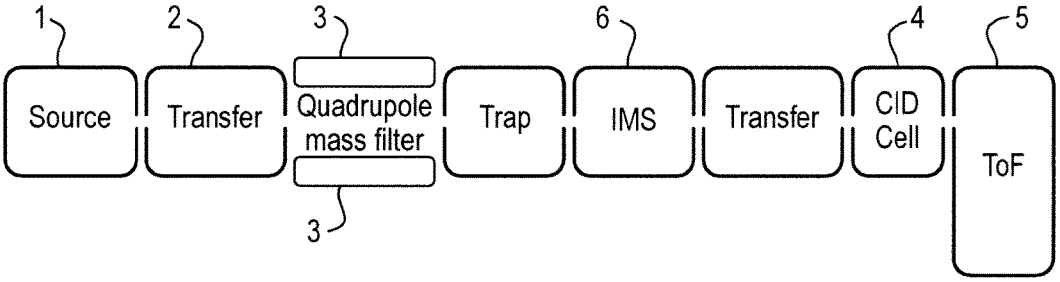
FIG. 7 shows a mass spectrometer according to an embodiment, in which a quadrupole mass filter precedes an ion mobility spectrometer or separator.

FIG. 7 shows a mass spectrometer comprising a quadrupole 3 that may be followed by an ion mobility spectrometer or separator 6.

Figure 8:
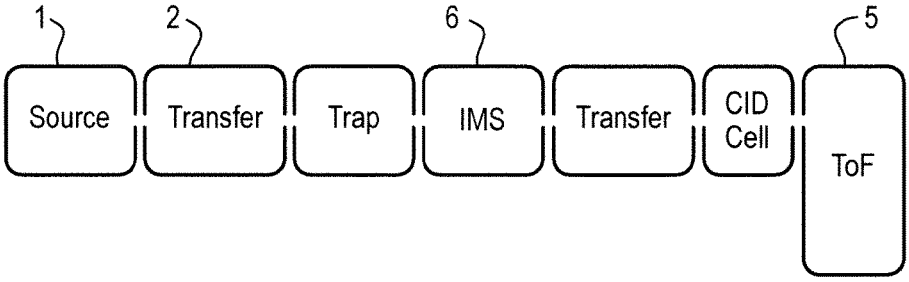
FIG. 8 shows a mass spectrometer according to an embodiment having an ion mobility separation time of flight ("IMS-ToF") configuration.
Figure 9:
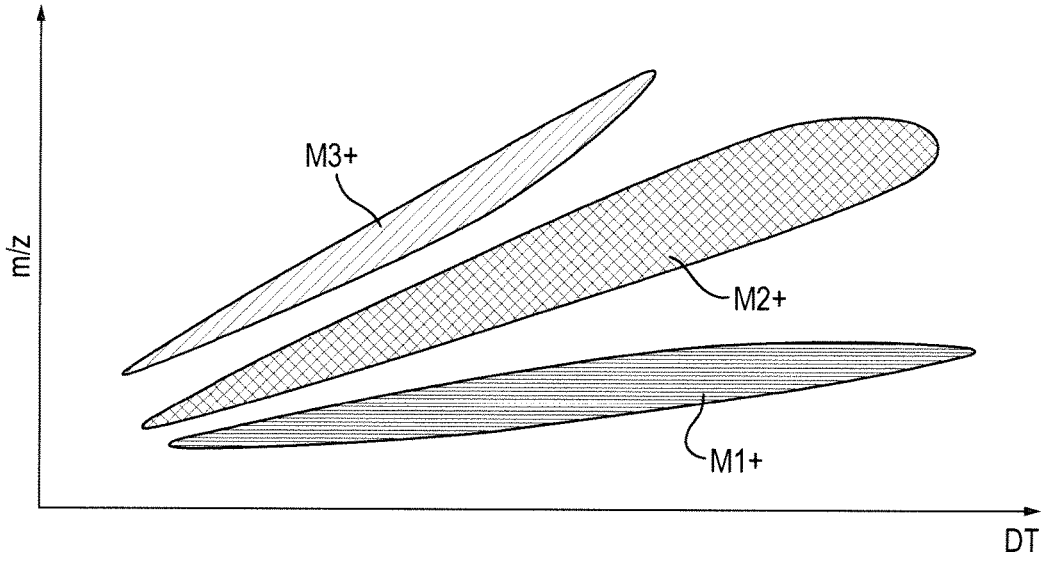
FIG. 9 shows a graph illustrating a relationship between mass to charge ratio, drift time and charge state.

FIG. 8 shows an ion mobility separation time of flight ("IMS-ToF") configuration for a mass spectrometer that may also benefit from the disclosed approach, without the need for a mass to charge ratio filter. Ions separated in an ion mobility spectrometer or separator 6 may be delivered to the orthogonal-acceleration time of flight mass analyser 5 in distinct mass to charge ratio ranges, optionally at any given drift time. This is illustrated in FIG. 9 and is due to the correlation between mass to charge, ion mobility and charge state. The separation of the mass to charge ratio ranges may allow the aforementioned approach to be adopted again improving duty cycle and dynamic range.

The disclosed aspects and embodiments may be combined with other established time of flight techniques such as Enhanced Duty Cycle ("EDC") and High Duty Cycle ("HDC") techniques.

The disclosed aspects and embodiments may form part of a more complex and/or comprehensive acquisition strategy.

The disclosed aspects and embodiments may be applicable to or comprise any filter separation combination, such as an ion mobility filter followed by an ion mobility spectrometer or separator.

The disclosed aspects and embodiments may improve the duty cycle and dynamic range of time of flight systems operating a targeted Selected Ion Monitoring ("SIR") or Selected Reaction Monitoring ("SRM") mode.

Although the present disclosure has been described with reference to various embodiments, it will be understood by those skilled in the art that various changes in form and detail may be made without departing from the scope of the disclosure as set forth in the accompanying claims.

The invention claimed is:

1. A mass spectrometer comprising:

a time of flight mass analyser comprising an acceleration electrode, a time of flight region and an ion detector; and a control system arranged and adapted:

(i) to apply a plurality of extraction pulses to said acceleration electrode in order to accelerate consecutive groups of ions into said time of flight region, wherein ions within each consecutive group of ions have a mass to charge ratio within one or more predetermined, selected or otherwise known mass to charge ratio ranges;

(ii) to determine a frequency or period of said plurality of extraction pulses that will cause ions that are accelerated by the acceleration electrode and have a relatively high mass to charge ratio in a preceding group of ions to arrive at said detector after ions that are accelerated by the acceleration electrode and have a relatively low mass to charge ratio in a subsequent group of ions, and avoid coincidence of ions from said consecutive groups of ions at said ion detector; and (iii) apply said plurality of extraction pulses at said determined frequency or period, such that different groups of ions accelerated by the acceleration electrode are intermixed and coincidence of ions from the different groups of ions is avoided.

2. A mass spectrometer as claimed in claim 1, wherein said frequency or period is determined by calculating the times of flight of ions in said consecutive groups of ions, and determining a frequency or period of said plurality of extraction pulses that will prevent ions from one group of ions arriving at said detector at substantially the same time as ions from another group of ions.

3. A mass spectrometer as claimed in claim 1, wherein the times of flight of ions in said consecutive groups of ions are calculated based on said predetermined, selected or otherwise known mass to charge ratio ranges.

4. A mass spectrometer as claimed in claim 1, further comprising a restriction device arranged and adapted to restrict the mass to charge ratio range of ions in each consecutive group of ions to said one or more predetermined, selected or otherwise known mass to charge ratio ranges.

5. A mass spectrometer as claimed in claim 4, further comprising a separator or filter arranged and adapted to sequentially select and transmit a plurality of ions of interest based upon a first physico-chemical property.

6. A mass spectrometer as claimed in claim 5, wherein said separator or filter is arranged upstream or downstream of said restriction device.

7. A mass spectrometer as claimed in claim 5, wherein said first physico-chemical property comprises mass or mass to charge ratio.

8. A mass spectrometer as claimed in claim 1, wherein:

said plurality of extraction pulses comprises a first extraction pulse applied to said acceleration electrode in order to accelerate a first group of ions into said time of flight region at a first time T1, wherein ions having the lowest mass to charge ratio in said first group of ions have a time of flight $\Delta T1_{min}$ through said time of flight region and ions having the highest mass to charge ratio in the first group of ions have a time of flight $\Delta T1_{max}$ through the time of flight region;

said plurality of extraction pulses comprises a second extraction pulse applied to said acceleration electrode at a subsequent second time in order to accelerate a second group of ions into said time of flight region at a second time T2; and $$T2-T1<\Delta T1_{max}-\Delta T1_{min}.$$

9. A mass spectrometer as claimed in claim 8, wherein ions having the lowest mass to charge ratio in said second group of ions have a time of flight $\Delta T2_{min}$ through said time of flight region and ions having the highest mass to charge ratio in said second group of ions have a time of flight $\Delta T2_{max}$ through said time of flight region, and $$T2-T1\geq\Delta T2_{min}-\Delta T1_{min}.$$

10. A mass spectrometer as claimed in claim 8, wherein said control system is arranged and adapted to apply third and/or further extraction pulses to said acceleration electrode in order to accelerate third and/or further groups of ions into said time of flight region.

11. A mass spectrometer as claimed in claim 10, wherein said first, second, third and/or further extraction pulses are applied and/or timed such that ions from different groups of ions do not coincide with one another at said detector.

12. A mass spectrometer as claimed in claim 1, wherein said control system is arranged and adapted to identify and/or determine a range of frequencies or periods of said extraction pulses that will avoid coincidence of ions from different groups of ions at said ion detector.

13. A mass spectrometer as claimed in claim 12, wherein said plurality of extraction pulses are applied at the highest frequency or lowest period identified and/or determined.

14. A mass spectrometer as claimed in claim 12, wherein the control system is arranged and adapted to increase the frequency or decrease the period of said extraction pulses to a frequency or period within the range of frequencies or periods of said extraction pulses that will avoid coincidence of ions from different groups of ions at said ion detector.

15. A method of mass spectrometry comprising:

providing a time of flight mass analyser comprising an acceleration electrode, a time of flight region and an ion detector, wherein a plurality of extraction pulses are applied to said acceleration electrode in order to accelerate consecutive groups of ions into said time of flight region, wherein ions within each consecutive group of ions have a mass to charge ratio within one or more predetermined, selected or otherwise known mass to charge ratio ranges;

ions that are accelerated by the acceleration electrode and have a relatively high mass to charge ratio in a preceding group of ions arrive at said detector after ions that are accelerated by the acceleration electrode and have a relatively low mass to charge ratio in a subsequent group of ions, and in addition will avoid coincidence of ions from said consecutive groups of ions at said ion detector; and applying said plurality of extraction pulses at said determined frequency or period, such that different groups of ions accelerated by the acceleration electrode are intermixed whilst coincidence of ions from the different groups of ions is avoided.

16. A mass spectrometer as claimed in claim 1, wherein ions within at least one of the consecutive groups of ions have a mass to charge ratio within a different predetermined, selected or otherwise known mass to charge ratio range than the predetermined, selected or otherwise known mass to charge ratio range of at least one other of the consecutive groups of ions.

17. A mass spectrometer as claimed in claim 1, wherein the consecutive groups of ions comprise a plurality of pre-isolated groups of ions, each of the pre-isolated groups of ions have a mass to charge ratio within a different isolated mass to charge ratio range.

18. A method of mass spectrometry as claimed in claim 15, wherein ions within at least one of the consecutive groups of ions have a mass to charge ratio within a different predetermined, selected or otherwise known mass to charge ratio range than the predetermined, selected or otherwise known mass to charge ratio range of at least one other of the consecutive groups of ions.

19. A method of mass spectrometry as claimed in claim 15, wherein the consecutive groups of ions comprise a plurality of pre-isolated groups of ions, each of the pre-isolated groups of ions have a mass to charge ratio within a different isolated mass to charge ratio range.

* * * * *